US006205927B1

(12) United States Patent
Findley

(10) Patent No.: US 6,205,927 B1
(45) Date of Patent: Mar. 27, 2001

(54) ELECTRIC IMPULSE CARTRIDGE

(76) Inventor: Stephan D. Findley, 710 Willow St., Marshall, TX (US) 75670

( * ) Notice: Subject to any disclaimer, the term of this patent is extended or adjusted under 35 U.S.C. 154(b) by 0 days.

(21) Appl. No.: 09/187,951

(22) Filed: Nov. 6, 1998

(51) Int. Cl.[7] ..... F42B 3/14
(52) U.S. Cl. ..... 102/472
(58) Field of Search ..... 102/200, 206, 102/472, 470, 202.5, 202.8

(56) References Cited

U.S. PATENT DOCUMENTS

| | | | | |
|---|---|---|---|---|
| 2,072,621 | | 3/1937 | Gagle . | |
| 2,548,946 | | 4/1951 | Clauser et al. . | |
| 2,918,871 | | 12/1959 | Taylor . | |
| 3,563,177 | | 2/1971 | Ritchey . | |
| 3,726,217 | | 4/1973 | Dedman et al. . | |
| 3,754,506 | | 8/1973 | Parker . | |
| 3,844,216 | * | 10/1974 | Jakobs et al. | 102/46 |
| 3,977,328 | * | 8/1976 | Brown et al. | 102/202.8 |
| 4,070,970 | | 1/1978 | Scamaton . | |
| 4,130,060 | * | 12/1978 | Murray | 102/472 |
| 4,217,717 | | 8/1980 | Canty et al. . | |
| 4,329,924 | * | 5/1982 | Lagofun | 102/202.8 |
| 5,044,278 | | 9/1991 | Campbell . | |
| 5,235,127 | | 8/1993 | Findley . | |
| 5,353,710 | | 10/1994 | Eches et al. . | |
| 5,361,702 | | 11/1994 | Goetz . | |
| 5,515,783 | | 5/1996 | Hesse et al. . | |
| 5,625,972 | | 5/1997 | King et al. . | |
| 5,739,459 | | 4/1998 | La Mura et al. . | |
| 5,767,439 | | 6/1998 | Lindblom et al. . | |
| 5,996,500 | * | 12/1999 | Findley | 102/202.8 |

FOREIGN PATENT DOCUMENTS

| | | | | |
|---|---|---|---|---|
| 3545589 | * | 7/1987 | (DE) | 102/206 |
| 816530 | | 7/1959 | (GB) . | |

* cited by examiner

*Primary Examiner*—Thomas Price
(74) *Attorney, Agent, or Firm*—Randall C. Brown; Michael E. Martin; Akin, Gump, Strauss, Hauer & Feld, L.L.P.

(57) ABSTRACT

An electric pyrotechnic cartridge or primer device comprises a generally cylindrical nonconductive plastic body having a conical cavity opening to one end wall, a rod-like electrode centered in the cavity and extending to the opposite end wall and a second rod-like electrode extending from a side wall of the body into the cavity in proximity to but spaced from the first electrode. Alternatively, the second electrode may comprise a coating of conductive material applied to a conical wall surface defining the cavity. An explosive or pyrotechnic charge is disposed in the cavity and is ignited by a high voltage electric signal imposed on the electrodes. The electrodes are preferably formed of an ABS plastic composition which may be filled or doped with carbon, carbon fibers, metal particles, aluminized fiberglass, and explosive compositions selected from combinations of boron, molybdenum trioxide, magnesium, barium chromate, potassium perclorate, a fluoroelastomer and polytetrafluoroethylene. Electrodes formed of ABS plastic composition filled with carbon or metal particles provide a reduced firing time on the imposition of the electric signal on the device, and consumable electrodes formed of ABS and a combination of the explosive compositions has a further reduced firing time and imposition of substantial energy on an explosive composition in the cavity.

24 Claims, 2 Drawing Sheets

ELECTRIC IMPULSE CARTRIDGE

FIELD OF THE INVENTION

The present invention pertains to an electric impulse cartridge or primer device for igniting explosive or pyrotechnic charges wherein the device is provided with improved high energy emission and high ignition rate combustible electrodes which significantly reduce the elapsed time from generation of an electrical firing signal to ignition of a charge in the device and an associated explosive or pyrotechnic charge.

BACKGROUND

This invention is related to the electrical or electrostatic discharge pyrotechnic cartridge and primer device inventions disclosed and claimed in my U.S. Pat. No. 5,235,127 issued Aug. 10, 1993 and my co-pending U.S. patent application Ser. No. 08/688,085 filed Jul. 29, 1996. The electrically fired primers or cartridges described in the above referenced patent and pending patent application provide certain advantages over conventional bridge wire type igniters or primers which are susceptible to the effects of unwanted or stray electromagnetic radiation, sometimes referred to as the high energy radio output (HERO) effect. Although the primer devices or cartridges disclosed and claimed in my prior patent and patent application provide certain advantages as set ford therein, there has been a continuing need to provide a cartridge or primer device which has a higher rate of energy output and a reduced firing cycle time. In the ignition of ordnance charges, for example, it is desirable to minimize the firing time once the ignition or firing signal has been transmitted to the ordnance apparatus. Moreover, the cost of simulated ordnance devices and the residue provided by prior art primer devices or igniters has also driven the effort to develop still further improvements in impulse cartridges or primer devices for use with ordnance charges and other pyrotechnic devices and wherein such primer devices may be reused or at least the material of which they are made can be recycled. It is to these ends that the present invention has been developed.

SUMMARY OF THE INVENTION

The present invention provides an improved electrically fired or ignited cartridge or primer device for providing ignition of a primer charge of explosive or pyrotechnic material which, in itself, may produce a useful concussion, visible light and noise effect or may be used to ignite additional explosive or pyrotechnic charges for simulating ordnance discharges. The cartridge may also be used in live ordnance devices for energizing or igniting same.

In accordance with one aspect of the present invention an electric cartridge or primer device is provided which is formed of a molded plastic body or case provided with a cavity for receiving a pyrotechnic or explosive composition. The cartridge is also provided with improved electrodes which are formed of compositions which provide for generation of a high rate of energy output in a minimum amount of time to ignite the pyrotechnic or explosive charge of the device, which in turn may be used to ignite additional charges or compositions.

In accordance with another aspect of the present invention the electrodes of the impulse cartridge may be formed of electrically conductive plastic or similar compositions which may be doped with conductive materials which improve the firing speed and the energy output from the electrodes into the associated charge of explosive or pyrotechnic composition. The electrode dopant materials also provide an electrical resistance value which is useful for identifying the particular type of cartridge or primer device in place in an ordnance system. The cartridge body may also be doped with materials which provide a predetermined electrical resistance to a low voltage pulse of predetermined voltage and/or frequency. Accordingly, a discrete low voltage interrogation pulse may be imposed on the device to measure the resistance and identify the particular cartridge.

In accordance with still another aspect of the present invention the cartridge electrodes may be formed of a conductive thermoplastic, such as ABS (acrylonitrile-butadiene-styrene) which is doped with combinations of combustible or explosive compositions selected from a group consisting of boron, molybdenum trioxide, magnesium, polytetrafluoroethylene, fluoroelastomers, barium chromate and potassium perclorate. Selected combinations of the dopants cumulatively amounting to approximately 20% to 80% of the electrode by weight, in combination with the ABS plastic, have been determined to provide a substantially reduced ignition time for the cartridge, in the range of ten milliseconds or less, while providing substantial caloric output to ignite the cartridge charge as well as associated charges which are to be ignited by the cartridge. Such electrodes are electrically conductive and also undergo chemical conversion in response to a high voltage electrical potential thereacross to release energy and initiate energy release by other materials in proximity to the electrodes. Accordingly, the electrodes may be considered combustible, are consumed in the conversion process and may be defined as pyroconductive elements.

In accordance with still a further aspect of the present invention, an impulse cartridge or primer device is provided with pyroconductive electrodes which are suitable for molding and may be molded in place in conjunction with molding the cartridge body using conventional injection molding processes.

Still further, the present invention contemplates the provision of an electric impulse cartridge or primer device which is provided with a molded pyroconductive electrode and a second pyroconductive electrode which may comprise a conductive "ink" or coating which may be printed on the device body and arranged in a pattern which facilitates a very high rate of ignition or energization of the device explosive charge composition.

Those skilled in the art will appreciate the above mentioned features and advantages of the invention together with other important aspects thereof upon reading the detailed description which follows in conjunction with the drawings.

DETAILED DESCRIPTION OF PREFERRED EMBODIMENTS

Figure 1:
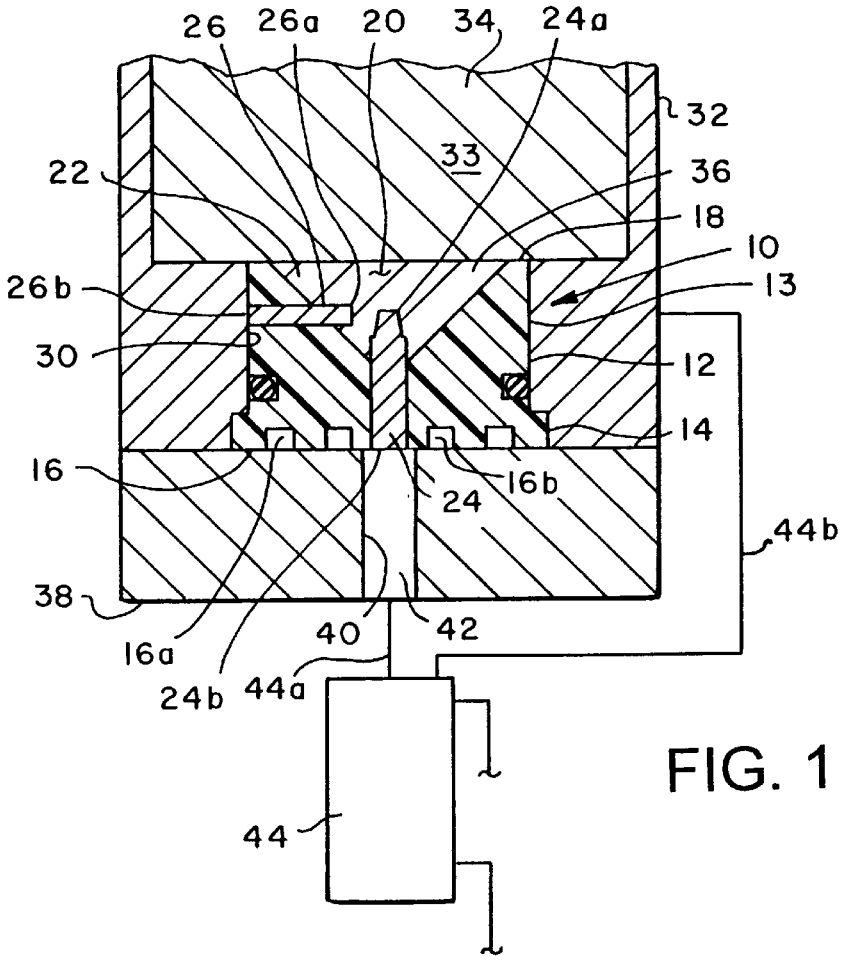
FIG. 1 is a central section view of an impulse cartridge or primer device in accordance with the invention mounted in an apparatus for generating a simulated or high energy explosive charge of a pyrotechnic material.

In the description which follows like elements are marked through the specification and drawing with the same reference numerals, respectively. The drawing figures are not necessarily to scale and certain elements may be shown in generalized or somewhat schematic form in the interest of clarity and conciseness.

Figure 2:
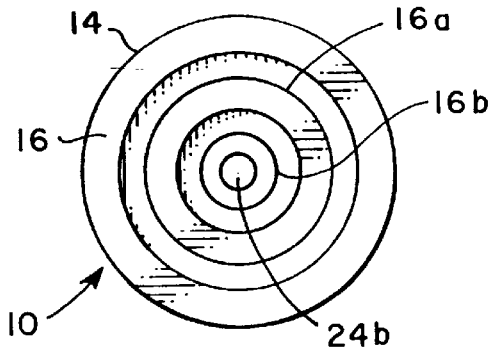
FIG. 2 is a bottom plan view of the cartridge shown in FIG. 1.
Figure 3:
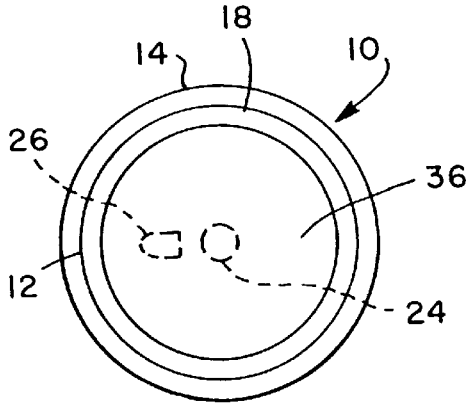
FIG. 3 is a top plan view of the cartridge shown in FIG. 1.

Referring to FIGS. 1 through 3, there is illustrated an impulse cartridge or primer device in accordance with the invention and generally designated by the numeral 10. As shown in the drawing figures the cartridge 10 comprises a generally cylindrical body member 12 having a peripheral flange 14 formed therearound at one end thereof. The body 12 has a generally planar bottom face or end wall 16 and a parallel transverse top face or end wall 18 which is intersected by a substantially conical shaped cavity 20 delimited by a conical wall 22. A first, generally cylindrical rod-like electrode 24 is disposed along the central longitudinal axis of the cylindrical body 12 and is coaxial, preferably, with an outer cylindrical side wall 13 of the body 12. The electrode 24 projects into the cavity 20 to a distal end 24*a* and is disposed adjacent a laterally projecting electrode 26 having a first end 26*a* disposed in proximity to the electrode end 24*a* but spaced therefrom to provide a suitable gap across which an electric arc may be generated, as will be described in further detail herein. The opposite end of electrode 26 is indicated as 26*b* and intersects the side wall 13 of the body 12. In like manner, the opposite end 24*b* of electrode 24 intersects the transverse bottom or endwall 16. Concentric annular grooves 16*a* and 16*b* are provided in endwall 16 to provide electrical current "dams" adapted to prevent current flow across endwall 16.

The cartridge 10 is adapted to be a snug fit in a cylindrical stepped bore 30 formed in a structure 32 which may comprise an ordnance device of one of selected types or may comprise a support barrel for an ordnance device. The body member 12 is preferably provided with a suitable annular seal member, such as an o-ring 15, disposed in a circumferential groove in the body 12 as shown, and engageable with bore 30. For purposes of discussion herein the body 32 may be considered an ordnance device which is provided with a cylindrical cavity 33 in which an explosive or pyrotechnic composition 34 is disposed. Accordingly, the cavity 20 opens to the cavity 33 and is exposed to the composition 34. In this regard the cavity 20 is preferably filled with a suitable explosive or pyrotechnic composition 36, such as black powder. The composition 36 when ignited will, in turn, ignite the explosive or pyrotechnic composition 34. The body 32 is somewhat exemplary and those skilled in the art will recognize that the cartridge or primer device 10 may be used in other arrangements to fulfill the purpose described herein.

In a typical operating environment for the cartridge 10, it is supported in the stepped bore 30 and retained therein by a suitable electrically non-conductive closure member 38 having a bore 40 formed therein and in which is disposed a conductor 42 which is in mechanical contact or close proximity to the end 24*b* of the electrode 24 to provide electrically conductive engagement therewith. The body 32 and the conductor 42 are adapted to be in circuit with a suitable source 44 of a high voltage electrical signal. The source 44 may be an electric coil type device for imposing a high voltage electric signal on the electrodes 24 and 26. For example, a multiple pulse electric signal having a peak voltage of 14,000 volts DC at a pulse rate of 1600 Hertz may be generated to effect a spark of arc between the electrode ends 24*a* and 26*a* to ignite the material 36 and subsequently the material 34, for example. The electrical circuit which is completed by imposing the above-mentioned voltages on the device 10 is through a conductive path comprising the conductor 42, the electrode 24, the gap between the electrode distal ends 24*a* and 26*a*, the electrode 26, the body 32 and the circuit including suitable conductors 44*a* and 44*b* connected to the source 44.

The cartridge or primer device 10 may be fabricated by premolding or otherwise forming the electrodes 24 and 26 and then placing these electrodes in a mold which will provide for molding the body 12 around the electrodes. The cavity 20 may be molded or machined after molding the body 12. A preferred method of fabrication is to mold the body 12 in a two step injection mold apparatus which includes retractable pins to define the bores for electrodes 24 and 26 and then inject the electrode material to form the electrodes without removing the body 12 from the mold until completion. Alternatively, another method of fabrication is to prefabricate the electrodes 24 and 26 by molding and then placing these members in a mold which is used to mold the body 12 with the electrodes in place.

In accordance with the present invention, the body 12 may be fabricated from molding a suitable type of non-conductive thermoplastic or thermosetting material such as nylon, propylene, polypropylene or preferably ABS plastic materials. The body 12 may also be produced from a glass/ceramic material which may be suitable for certain applications, such as aerospace ordnance, which require physical and chemical stability over a wider range of environmental operating conditions.

One preferred material for fabrication of the body 12 is an acrylonitrile-butadiene-styrene (ABS) composition available from Cheil Industries, Inc. as their STAREX grade ABS molding composition.

Still further, the electrodes 24 and 26 may be fabricated, preferably by molding, from a conductive thermoplastic or thermosetting composition, including nylon, propylene, polypropylene and ABS and wherein these compositions are doped or filled with a suitable quantity of carbon, carbon fibers, metals or aluminized fiberglass. These doping materials provide a suitable conductivity of the electrode material which enable these electrodes to rapidly conduct the high voltage electric signal mentioned above to provide an arc between the distal ends 24*a* and 26*a* of the respective electrodes to rapidly ignite or cause combustion of the material 36 in the cavity 20. Moreover, the dopant added to the base thermoplastic or thermosetting composition for the electrodes 24 and 26 will provide a measurable resistance value when a low voltage signal is imposed on the electrodes to interrogate the device 10 to determine if it is operable and, in fact, the composition of the electrodes may be used as an identifier as to which cartridge or device 10 is being interrogated.

Again, as mentioned above, for certain applications which require chemical and mechanical stability over a substantial range of environmental conditions, the electrodes may be formed from a solid metal, such as copper, aluminum or steel. Still further, the electrodes may be formed of a conductive polycarbonate plastic doped with one or more of the above-mentioned conductive dopant materials.

An important aspect of the present invention is the provision of electrodes which are consumable or are considered pyroconductive. By providing electrodes 24 and 26 of consumable, combustible or pyroconductive materials the energy transferred to the explosive or combustible charge 36 is greater and is transferred more rapidly than with solid metal or other non-consumable electrodes. The material 36 may be somewhat pyroconductive although the voltages used in creating the arc between the electrode ends 24*a* and 26*a* is sufficient to provide a conductive path even in a substantially nonconductive explosive or pyrotechnic material in the cavity 20.

A preferred material for the electrodes 24 and 26, which are consumable or pyroconductive when suitably doped, is an acrylonitrile-butadiene-styrene (ABS) terpolymer commercially available from RTP Company of Winnona, Minn. as their grade RTP0685 ABS. This material, when doped with selected other materials, provides a substantially increased energy (caloric) output upon having an electric ignition signal imposed thereon as described hereinbefore. The compositions of the electrodes 24 and 26 which are preferred in accordance with one aspect of the invention is given below. The percentage of each composition is by weight.

Composition I

RTP 0685—40% to 80%

Explosive compound—20% to 60% (boron 6%, molybdenum trioxide 94%)

Composition II

RTP 0685—40% to 80%

Explosive compound—20% to 60% (magnesium 70%, polytetrafluoroethylene 23%, fluoroelastomer 7%)

Composition III

RTP 0685—40% to 80%

Explosive compound—20% to 60% (boron 15%, barium chromate 85%)

Composition IV

RTP 0685—40% to 80%

Explosive compound—20% to 60% (boron 20%, potassium perclorate 70%, fluoroelastomer 10%)

Figure 4:
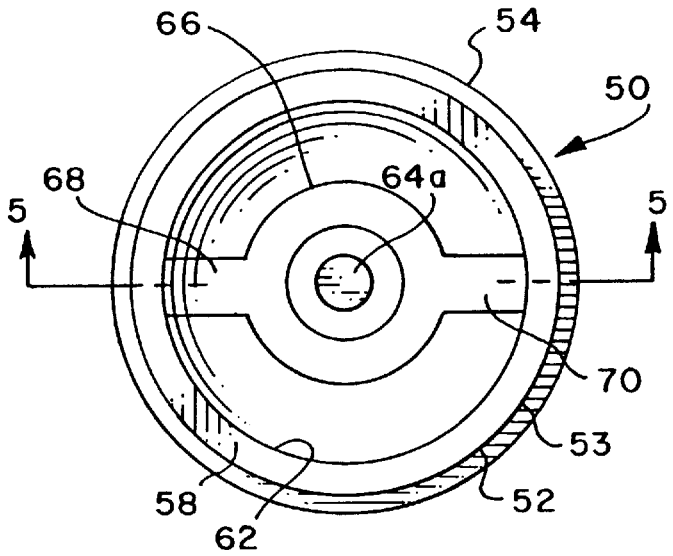
FIG. 4 is a top plan view of a first alternate embodiment of a cartridge in accordance with the invention.
Figure 5:
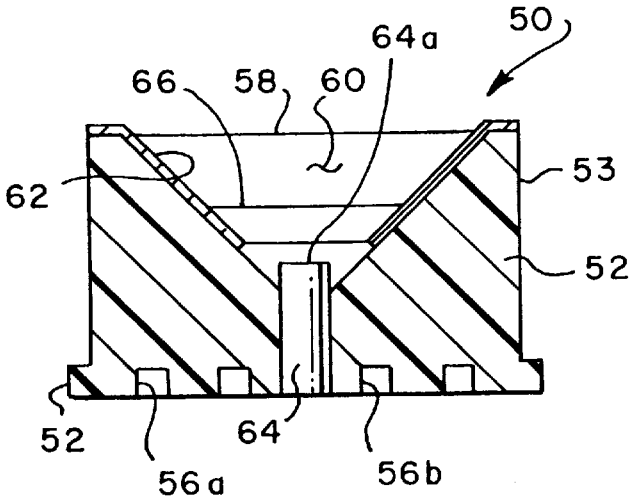
FIG. 5 is a section view taken along the line 5—5 of FIG. 4.

Referring now to FIGS. 4 and 5, an alternate embodiment of a cartridge or primer device in accordance with the invention is illustrated and generally designated by the numeral 50. The device 50 is similar in some respects to the device 10 and includes a generally cylindrical body 52 having a cylindrical outer sidewall 53, a peripheral flange 54, a bottom transverse face or end wall 56 and a top transverse face or end wall 58. Electrical cement dams are provided by concentric annular grooves 56*a* and 56*b* intersecting endwall 56. A substantially conical cavity 60 is delimited by a conical side wall 62 the base of which opens to the end wall 58. A center electrode 64 comprising a generally cylindrical rod projects into the cavity 60 and also intersects and is flush with the endwall 56. The electrode 64 may be molded of one of the compositions described hereinabove. A suitable pyrotechnic or explosive composition, not shown, may be deposited in the cavity 60. The cartridge 50 is provided with a unique second electrode comprising a generally circular deposit of conductive coating or "ink" 66 on the surface of the conical wall 62 in proximity to the distal end 64*a* of the electrode 64 but spaced sufficiently therefrom to require a high voltage potential to arc across the gap between the electrode distal end and the circular electrode 66. The circular electrode 66 includes opposed radial and axially extending arm portions; 68 and 70 which extend along the conical wall 62 and radially outwardly along the wall 58 to intersect the cylindrical wall surface 53. In this way, if the cartridge or primer device 50 is placed in the bore 30 in place of the cartridge 10, electrically conductive contact may be made between the body 32 and the electrode arms 68 and 70 to form a conductive path wherein a substantial arc will only be generated in the circumferential gap between the distal end 64*a* of the electrode 64 and the circular ring portion of electrode 66. The coating forming the electrode 66 may be any ink or paint-like material or a thermosetting polymer which is doped with metallic fines, carbon particles or the compositions mentioned hereinabove and painted or silk-screened onto the wall surfaces 62 and 58. In this way, a uniform distribution of the cartridge electrical firing signal around the cavity 60 may be obtained.

Figure 6:
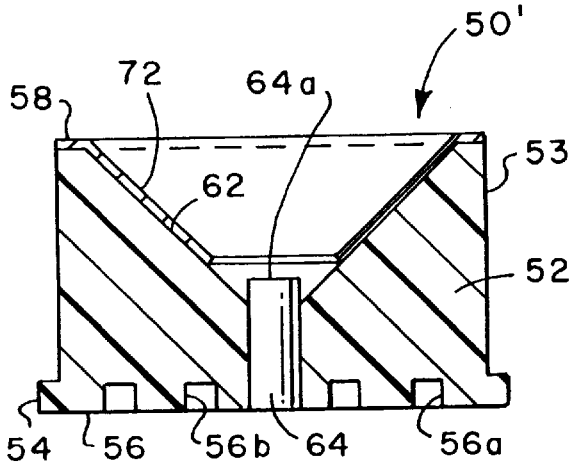
FIG. 6 is a section view similar to FIG. 5 showing as embodiment of a cartridge in accordance with the invention.

Referring to FIG. 6, a cartridge 50' is illustrated and is substantially like cartridge 50 except a coating comprising the second electrode is formed as a substantially uniform frustoconical deposit, as shown, and indicated by numeral 72 wherein the entire surface of conical wall 62 and the peripheral surface forming the end wall 58 may have the conductive coating applied thereto. Such an arrangement provides a still further uniform and all encompassing distribution of the energy of the consumable or pyroconductive electrode 72. The composition of the electrode 72 may be the same as the electrode 66.

The consumable or combustible electrodes described hereinabove, using the materials described, provide for substantially faster ignition and conversion of certain explosive materials which are relatively insensitive to electric arcs but are only ignitable by a greater amount of energy applied thereto, such as by the combustion or rapid oxidation of the electrodes themselves. Accordingly, the mechanism of initiation of combustion of certain explosive or combustible "pyrotechnic" materials using a cartridge or primer device as described herein occurs when a conductive path is established between the two electrodes of the embodiments of the cartridge, such as the cartridges 10, 50 and 50' wherein, once an electric arc is initiated or established between the electrodes of the cartridges the electrodes themselves undergo conversion or combustion to produce even more energy to initiate conversion or combustion of an explosive or highly pyrotechnic composition disposed in the cartridge cavity, such as the black powder composition described above, and this composition may in turn be used to initiate conversion or combustion of additional explosive or pyrotechnic materials.

The rate at which this activity occurs is substantially increased over the rate at which combustion begins in explosive materials ignited by conventional metal or metal filled plastic, non-consumable electrodes. For example, a cartridge such as the cartridge 10, using a black powder explosive composition for the composition 36 with electrodes formed of metal filled polycarbonate will require approximately 1.25 seconds to initiate substantial combustion of the material 36. By providing the electrodes of the cartridges 10, 50 and 50' formed of ABS plastic of the type mentioned above and doped with carbon, carbon fibers, metal particles and aluminized fiberglass, for example, the "firing" time of the cartridge may be reduced to about 10 milliseconds. Still further, by providing the electrodes of the cartridges 10, 50 and 50' of the above referenced ABS composition (RTP 0685) and the dopants described above for Compositions I through IV, the cartridge "firing" time may be reduced to less than 10 milliseconds thanks to the pyroconductive nature of the electrodes.

Although preferred embodiments of the present invention have been described in detail hereinbefore those skilled in the art will recognize that various substitutions and modifications may be made to the invention without departing from the scope and spirit of the appended claims.

What is claimed is:

1. An electric cartridge comprising:

a substantially electrically nonconductive body having a first end wall and a second end wall spaced from said first end wall and a cavity formed in said body;

a first electrode having an end extending into said cavity; and a second electrode spaced from said end of said first electrode in said cavity, at least one of said electrodes being combustible upon transmitting an electric current firing signal therethrough to initiate firing of said cartridge.

2. The cartridge set forth in claim 1 wherein:

said first and second electrodes are formed of a composition which is combustible in response to an electric firing signal.

3. The cartridge set forth in claim 2 wherein:

at least one of said first and second electrodes comprises a thermoplastic material doped with a composition selected from the group consisting of boron, molybdenum trioxide, magnesium, polytetrafluoroethylene, a fluoroelastomer, barium chromate and potassium perclorate.

4. The cartridge set forth in claim 3 wherein:

said thermoplastic material comprises an ABS polymer composition.

5. The cartridge set forth in claim 4 wherein:

said first and second electrodes comprise about 40% to 80% by weight of an ABS polymer composition and about 20% to 60%, by weight of a dopant composition comprising about 6% by weight boron and about 94% by weight of molybdenum trioxide.

6. The cartridge set forth in claim 4 wherein:

said first and second electrodes comprise about 40% to 80% by weight of an ABS polymer composition and about 20% to 60% by weight of a dopant composition comprising about 70% by weight of magnesium, about 23% by weight of polytetrafluoroethylene and about 7% by weight of fluoroelastomer.

7. The cartridge set forth in claim 4 wherein:

said first and second electrodes comprise about 40% to 80% by weight of an ABS polymer composition and about 20% to 60% by weight of an explosive composition comprising about 15% by weight of boron and about 85% by weight of barium chromate.

8. The cartridge set forth in claim 4 wherein:

said first and second electrodes comprise about 40% to 80% by weight of an ABS polymer composition and about 20% to 60% weight of an explosive composition comprising about 20% by weight of boron, about 70% by weight of potassium perclorate and about 10% by weight of fluoroelastomer.

9. The cartridge set forth in claim 1 wherein:

said first electrode comprises a rod extending into said cavity and said second electrode comprises a rod extending laterally from said cavity through a side wall of said body.

10. The cartridge set forth in claim 9 wherein:

said rod extends through one of said endwalls and said body includes at least one annular groove in said one endwall disposed around said rod to provide an electrical current dam.

11. The cartridge set forth in claim 1 wherein:

said first electrode comprises a rod extending into said cavity and said second electrode comprises an electrically conductive coating formed at least in part on a wall defining said cavity.

12. The cartridge set forth in claim 11 wherein:

said electrically conductive coating extends to an exterior surface of said body to form a conductive path.

13. The cartridge set forth in claim 11 wherein:

said cavity is delimited by a substantially conical wall opening to one end wall of said body and said second electrode comprises a coating covering a major portion of said conical wall.

14. An electric primer device for firing an explosive or combustible material, said primer device comprising:

a substantially electrically nonconductive cylindrical body having a first transverse end wall and a second transverse end wall spaced from said first transverse end wall, a cavity in said body defined by a wall surface, said cavity intersecting said second transverse end wall;

a first elongated rod shaped electrode having a distal end extending into said cavity, said first electrode being supported on said body and having a second end extending to said first transverse end wall; and a second electrode having a first part extending into said cavity and a second part extending to a peripheral side wall of said body.

15. The primer device set forth in claim 14 wherein:

said second electrode comprises an elongated rod member.

16. The primer device set forth in claim 14 wherein:

said second electrode comprises a coating disposed on at least a portion of said wall surface defining said cavity and delimited by an edge disposed in proximity to but spaced from said distal end of said first electrode.

17. The primer device set forth in claim 14 wherein:

said cavity is substantially conical shaped and has a base end opening to said second transverse end wall.

18. An electric cartridge comprising:

a substantially electrically non-conductive cylindrical body having a, first transverse end wall, a second transverse end wall spaced from said first transverse end wall, a cylindrical outer sidewall interposed said transverse end walls and a generally conical shaped cavity formed in said body and opening to one of said end walls at a base of said cavity;

a first electrode having a distal end extending into said cavity, said first electrode being supported on said body and having a second end extending to said first transverse end wall; and a second electrode having a first part extending into said cavity and a second part extending to said sidewall of said body;

said electrodes being formed of compositions which are electrically conductive and are combustible in response to a predetermined electrical signal intensity imposed on said electrodes and wherein, upon imposition of said predetermined electrical signal on said electrodes, an electric arc is generated in said cavity and at least portions of said electrodes are consumed to release energy to ignite a pyrotechnic material disposed in said cavity.

19. The cartridge set forth in claim 18 wherein:

at least one of said electrodes is formed of an ABS polymer composition doped with at least two compositions selected from the group consisting of boron, molybdenum trioxide, magnesium, polytetrafluoroethylene, a fluoroelastomer, barium chromate and potassium perclorate.

20. The cartridge set forth in claim 19 wherein:

said electrodes comprise about 40% to 80% by weight of an ABS polymer composition and about 20% to 60% by weight of a dopant composition, comprising about 6% by weight of boron and about 94% by weight of molybdenum trioxide.

21. The cartridge set forth in claim 19 wherein:

said electrodes comprise about 40% to 80% by weight of an ABS polymer composition and about 20% to 60% by weight of a dopant composition comprising about 70% by weight of magnesium, about 23% by weight of polytetrafluoroethylene and about 70%, by weight of fluoroelastomer.

22. The cartridge set forth in claim 19 wherein:

said electrodes comprise about 40% to 80% by weight of an ABS polymer and about 20% to 60% of weight of an explosive composition comprising about 15% by weight of boron and about 85% by weight of barium chromate.

23. The cartridge set forth in claim 19 wherein:

said electrodes comprise about 40% to 80% by weight of an ABS polymer and about 20% to 60% by weight of an explosive composition comprising about 20% by weight of boron, 70% by weight of potassium perclorate and about 10% by weight of fluoroelastomer.

24. The cartridge set forth in claim 18 wherein:

said body is formed by molding said body in a mold in a first step of a molding process and at least one of said electrodes is formed by molding a composition in said body and in said mold in a subsequent step in said molding process to form said one electrode.

* * * * *